US005115653A

United States Patent [19]

Beisemann et al.

[11] Patent Number: 5,115,653

[45] Date of Patent: May 26, 1992

[54] METHOD OF STRAIGHTENING ROLLED MATERIAL

[75] Inventors: Gerd Beisemann, Speyer; Klaus Pietsch, Düsseldorf, both of Fed. Rep. of Germany

[73] Assignee: SMS Schloemann-Siemag Aktiengesellschaft, Düsseldorf, Fed. Rep. of Germany

[21] Appl. No.: 680,621

[22] Filed: Mar. 20, 1991

Related U.S. Application Data

[63] Continuation of Ser. No. 441,765, Nov. 27, 1989, abandoned.

[30] Foreign Application Priority Data

Nov. 26, 1988 [DE] Fed. Rep. of Germany ..... 3840016

[51] Int. Cl.[5] ..... B21D 1/02; B21D 3/02

[52] U.S. Cl. ..... 72/8; 72/164

[58] Field of Search ..... 72/164, 160, 165, 8, 72/19, 20, 241

[56] References Cited

U.S. PATENT DOCUMENTS

| | | | |
|---|---|---|---|
| 3,566,638 | 3/1971 | Herbst | 72/8 |
| 3,596,489 | 8/1971 | Ball | 72/241 |
| 3,650,137 | 3/1972 | Benz | 72/165 |
| 4,152,913 | 5/1979 | Zerhoch | 72/165 |
| 4,454,738 | 6/1984 | Buta | 72/164 |
| 4,614,098 | 9/1986 | Kotera | 72/20 |
| 4,698,990 | 10/1987 | Petri | 72/165 |
| 4,730,472 | 3/1988 | Ellis | 72/164 |
| 4,805,492 | 2/1989 | Tsuruda | 72/20 |

FOREIGN PATENT DOCUMENTS

| | | | |
|---|---|---|---|
| 3430034 | 2/1986 | Fed. Rep. of Germany | 72/19 |

*Primary Examiner*—Daniel C. Crane
*Attorney, Agent, or Firm*—Toren, McGeady & Associates

[57] ABSTRACT

A method for straightening sheet, strips, sections, girders, etc. The method includes measuring the straightening forces of at least one of the straightening rolls in a straightening machine and adjusting the positions of the straightening rolls in accordance with the measured values. The method further includes individually measuring the straightening force acting perpendicularly on the axes of rotation of the straightening rolls, and/or the roll bearings and/or the frame, and automatically readjusting the straightening rolls in dependence upon these measured values in a range of the occurring varying pressure forces.

10 Claims, 1 Drawing Sheet

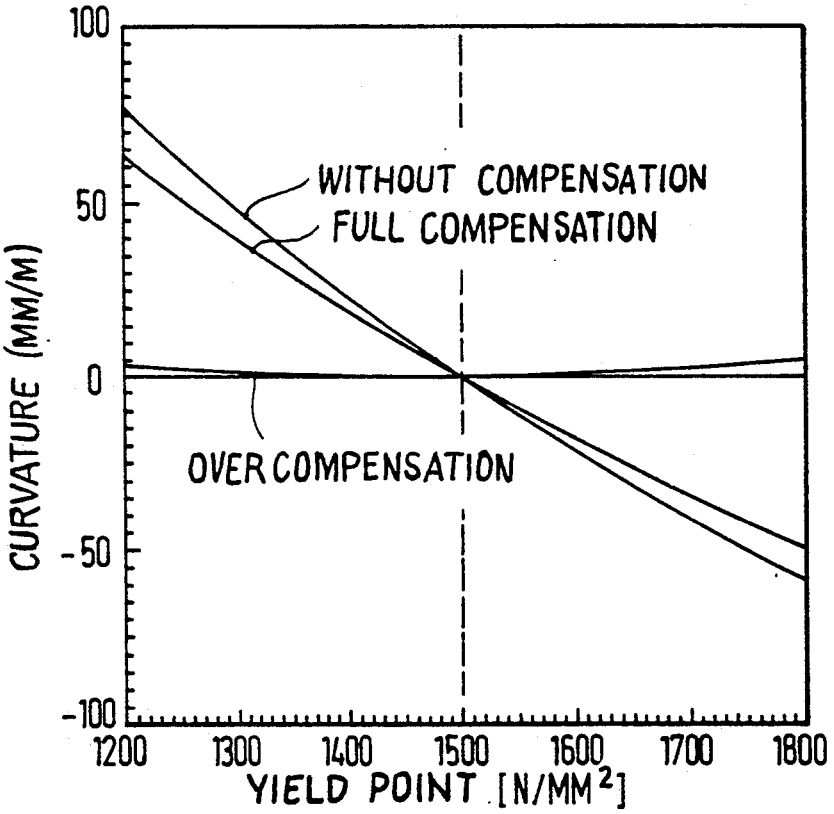
100
50
0
-50
-100
CURVATURE (MM/M)
WITHOUT COMPENSATION
FULL COMPENSATION
OVER COMPENSATION
1200
1300
1400
1500
1600
1700
1800
YIELD POINT [N/MM²]

METHOD OF STRAIGHTENING ROLLED MATERIAL

This is a continuation of U.S. application Ser. No. 07/441,765, filed Nov. 27, 1989 now abandoned.

BACKGROUND OF THE INVENTION

1. Field of the Invention

The present invention relates to a method for straightening rolled material, such as, sheets, strip, plates, sections, girders, etc. The method includes measuring the straightening forces of at least one of the straightening rolls in a roll straightening machine and adjusting the positions of the straightening rolls in accordance with the measured values.

2. Description of the Related Art

During the straightening procedure, vertical forces among other forces occur at the straightening rolls, wherein the vertical forces depend upon the properties of the material to be straightened, the dimensions of the straightening machine and the selected adjustments of the straightening rolls. These forces cause an elastic deformation of the straightening machine, particularly of the rolls, the bearings and the housing, resulting in a change (spring-back) of the roll positions which initially are usually adjusted without material to be straightened. Accordingly, the roll adjustments must be selected in such a way that the desired straightening effect is achieved with the changed adjustments occurring under load. Deviations of the properties of the material entering the straightening machine (temperature, width, thickness, modulus of elasticity, strength, yield point, etc.) from the values determining the selection of the roll adjustments usually lead to undesirable straightening results. For example, a change in strength leads to a changed curvature of the material leaving the straightening machine. Since changed properties of the material to be straightened result in changed straightening forces which, in turn, lead to changed spring-back values and, thus, to changed effective adjustments, it is apparent that the stability of the straightening result with scattered product parameters is essentially determined in part by the spring-back behavior of the straightening machine. The above results are based on practical experience in the past. For example, in high-strength, thick sheet metal, the spring-back may be even the dominating component of the effective roll adjustment.

The stiffness of the machine is also used for the approximate description of the spring-back behavior. A stiffness matrix is particularly suitable for the linearized description of the dependencies between individual roll forces and individual roll spring-backs. In addition, the elements of the matrix may depend on the respective point of operation. Computations have shown that a relationship exists between the property changes of the material entering the straightening machine (yield point) and the straightening results (curvature of the discharged material). For example, different machine stiffnesses have substantially different patterns. Similar relationships can also be shown for the parameters which depend on the thickness and width of the material. With respect to method technology, it is always an advantage if the scattering of the parameters have as little effect as possible on the bending process, i.e., functional patterns which are as flat as possible.

In straightening sheets, strips, plates, sections, girders, etc., the process is determined by the vertical positions of the straightening rolls selected in dependence on the desired straightening result and the properties of the material being straightened. Depending on the type and construction of the straightening machine, the upper and lower straightening rolls can be adjusted individually or jointly, as described by German Offenlegungsschrift 33 08 616 which discloses a method and an arrangement for straightening sheet metal. In addition to wedges and spindles, hydraulic piston-cylinder units can be used as adjusting devices.

In the known method described above, the adjustment and correction of the straightening roll gap is effected by means of control wedges which are in connection with pressure cylinders and spindle drives as displacement devices. The control wedges are arranged so as to extend in longitudinal direction of the straightening rolls and, therefore, are in the same manner in operative connection with the two bearings of the straightening roll. This results in one disadvantage that, when increased eccentric loads of the straightening rolls occur during the operation of the rolling mill due to changes of the cross-section and/or the strength of the rolled material, these eccentric increased loads are not immediately measured and, thus, cannot be corrected by adjusting the rolls without a time delay. This leads to an increased production of deficient finished products which must either be subjected to an expensive finishing operation or must again be melted down as waste.

Moreover, in this known method, the adjustment and correction of the straightening roll gap is not effected automatically, but manually. This causes a further time delay of the correction being made at the straightening rolls and increases the production of deficient final products. Also, in this known method, it is not possible to prevent elastic deformations of the straightening machine, particularly of the rolls, the bearings and the housing which not only negatively affects the straightening result of the material to be straightened, but also negatively affects the straightening machine.

It is, therefore, the primary object of the present invention to provide a method of the above-described type in which deviations and scattering of the properties of the material are determined without time delay and the consequences thereof are eliminated.

SUMMARY OF THE INVENTION

In accordance with the present invention, the abovedescribed method includes individually measuring the straightening force acting perpendicularly on the axes of rotation of the straightening rolls, and/or the roll bearings and/or the frame and automatically readjusting the straightening rolls in dependence upon these measured values in the range of the occurring varying pressure forces.

BRIEF DESCRIPTION OF THE DRAWING

The FIGURE shows in graph form a comparison of the reduced influence the material has on the straightening machine in known straightening machines without compensation and the straightening machine of the invention with full compensation.

DETAILED DESCRIPTION OF THE INVENTION

In accordance with the invention, each straightening force acting perpendicularly on the axes of rotation of the straightening rolls and/or the roll bearings and/or the housing of the straightening machine is measured individually. Thus, it is possible to measure directly at the straightening roll and correct without time delay any increased load occurring during the operation of the rolling mill, particularly also any eccentric increased load.

The correction of the straightening roll position in dependence on the measured value which occurs practically without time delay is achieved particularly by the automatic adjustment of the straightening roll. Thus, compared to the previously known methods, particularly increased loads occurring eccentrically on the straightening rolls, which are based on deviations and scattering of the material being straightened due to changes of the cross-section and/or strength of the material, are determined without time delay and are eliminated. This makes it possible to manufacture a faultless final product.

Moreover, the method steps of the present invention make it possible to eliminate any elastic deformations of the straightening machine, particularly of the rolls, the bearings and the housing and, thus, to facilitate the manufacture of a faultless straightened material.

The individual forces acting perpendicularly on the axes of rotation of the straightening rolls and/or roll bearings and/or housing of the straightening machine can be measured in the known manner very easily by a direct or indirect measurement, wherein the measurement of the straightening forces at the housing occur with the aid of the elastic deformations. In most cases, measuring devices of only a single known type are sufficient for this purpose.

For the adjustment of the straightening rolls, a known control device is provided which automatically carries out the correction of the straightening roll position which is adjustable during the straightening procedure, the correction being effected in dependence on the forces measured by means of the measuring devices and/or in dependence on the deformation distances measured by the measuring devices and possibly in dependence on the properties of the material being straightened, i.e., yield point, width, thickness, etc. The correction is effected in such a way that the parallel displacement of the straightening roll axes resulting from this correction extends in a direction which is opposite the direction determined by the displacement of the axes caused by the elastic deformations of the machine. As a result, deviations and scattering of the properties of the material being straightened does not affect the roll straightening machine.

In accordance with an advantageous feature of the invention, the adjustment or correction of the straightening rolls is carried out in dependence on the values measured on the material being straightened, such as, yield point, width, thickness, etc. As a result, the straightening results of the roll straightening machine are independent of the deviations and scattering of the properties of the material being straightened.

In accordance with a further development of the present invention, the adjustment or correction of the position of the straightening rolls is equal to the displacement of the straightening rolls due to the elastic deformation. As a result, a complete compensation of those influences, such as, elastic deformations, is achieved which emanate from the material being straightened and act on the straightening machine, particularly on the straightening rolls. This complete compensation causes the straightening machine to behave rigidly or almost indefinitely stiffly, while actual machine stiffness does not have to be high. In addition to a substantial reduction of the structural requirements of the straightening machine, the influence of deviations and scattering in the properties of the material being straightened are essentially reduced. As mentioned above, the FIGURE shows, compared to the previously known straightening machines without compensation (steep curve), the full compensation (flat curve) of the straightening machine according to the invention results in a substantial reduction of the influences of the material on the straightening machine.

It may also be very useful to effect an adjustment or correction of the straightening roll position which is greater than the displacement of the respective straightening roll carried out due to the elastic deformation. This corresponds to an over-compensation of the straightening machine, as indicated by the very flat or almost even curve in the FIGURE. An over-compensation of the elastic deformations which is suitably selected in dependence on the operation point of the straightening machine makes it possible to practically completely suppress an influence of the material being straightened on the straightening result over a wide scattering range (for example, of the strength) and, thus, to effect a stable behavior of the work process which in the past was not achieved.

The adjustment or correction of the straightening roll position may also be smaller than the displacement of the respective straightening roll effected on the basis of the elastic deformations. This corresponds to an only partial compensation of the influences of the material being straightened on the straightening machine. This may be advantageous if the number of straightening rolls which are adjustable under load is small relative to the total number of rolls.

The values for correcting the straightening roll positions are advantageously computed in accordance with the following formula and the corrections are effected in accordance with these values:

$$\begin{pmatrix} \Delta p_1 \\ \vdots \\ \Delta p_k \end{pmatrix} = C \begin{pmatrix} \vdots \\ \cdots m_{ij} \cdots \\ \vdots \end{pmatrix} \begin{pmatrix} F_1 \\ \vdots \\ F_l \\ u_1 \\ \vdots \\ u_m \end{pmatrix};$$

for $i=1, \ldots, k$ and $j=1, \ldots, l+m$, wherein $\Delta p_1, \ldots, \Delta p_k$: changes of the total number k of straightening roll positions adjustable under load, $F_1, \ldots, F_l$: measurement values of the total number l of force measuring locations, $u_1, \ldots, u_m$: measurement values of the total number m of measured elastic deformations, $m_{ij}$: partial derivatives of the straightening roll positions $a_1, \ldots, a_k$ belonging to $\Delta p_1, \ldots, \Delta p_k$ by the measurable forces or elastic deformations:

$$m_{ij} = -\frac{\theta\, \Delta a_i}{\theta\, F_j} \text{ for } j <= l;$$

$$m_{ij} = -\frac{\theta\, \Delta a_i}{\theta\, u_{j-l}} \text{ for } j > l, \text{ and}$$

C: multiplication factor which is adaptively adjustable manually and/or automatically in dependence on the product and /or depending on the straightening result, for example, between −2.5 and +2.5.

The correction values of the straightening roll positions can be very easily computed from case to case by means of PC computers and the straightening machine can be readjusted either force-controlled or position-controlled in dependence on the determined values.

The following numerical values may result, for example, in flat straightening machines:

Input Data

Number of rolls: 7
Roll diameter: 250 mm
Division: 150 mm
Sheet thickness: 10 mm
Sheet width: 3,500 mm
Yield point: 1,500 N/mm$^2$
Modules of elasticity for strip: 206,000 N/mm$^2$
Inlet curvature: 0.0 mm/m
Parallel stiffness: −1,060 kN/mm
Newton step width: 0.5

| Roll No. | Position of Roll Apex (mm) | Stiffness (n/mm) |
|---|---|---|
| 1 | 0.00 | 999999 |
| 2 | −13.28 | 999999 |
| 3 | 0.00 | 999999 |
| 4 | 2.11 | 999999 |
| 5 | 0.00 | 999999 |
| 6 | 17.50 | 999999 |
| 7 | 0.00 | 999999 |

Results

| Roll No. | Contact point (mm) | (mm) | Inclination (−) | Bending Moment (−) |
|---|---|---|---|---|
| 1 | 37.95 | −1.03 | −0.3186 | 0.0000 |
| 2 | 124.12 | −15.43 | −0.2116 | 1.4800 |
| 3 | 253.65 | −4.05 | 0.3993 | −1.4761 |
| 4 | 416.87 | 1.72 | −0.2749 | 1.4690 |
| 5 | 570.07 | 1.23 | 0.2467 | −1.4451 |
| 6 | 738.90 | 13.13 | −0.0891 | 1.3232 |
| 7 | 892.63 | 4.65 | 0.0591 | 0.0000 |

| Roll No. | Overstretching (−) | Straightening Force (kN) | Spring-back (mm) |
|---|---|---|---|
| 1 | 0.0000 | 1502.8 | −4.8678 |
| 2 | 5.0054 | 4504.4 | −4.8648 |
| 3 | −4,5464 | 4991.2 | −4.8643 |
| 4 | 3.9924 | 3551.8 | −4,8658 |
| 5 | −2.8315 | 3143.3 | −4.8662 |
| 6 | 1.3231 | 2266.9 | −4.8671 |
| 7 | −0.0001 | 685.7 | −4.8686 |

Total straightening force: 10,323.0 kN
Outlet curvature: −0.015 mm/m
Geometrically permissible EPS: 5.282 (not exceeded)

The various features of novelty which characterize the invention are pointed out with particularly in the claims annexed to and forming a part of this disclosure. For a better understanding of the invention, its operating advantages and specific objects attained by its use, reference should be had to the FIGURE and descriptive matter in which there is illustrated and described a preferred embodiment of the invention.

We claim:

1. In a method for straightening sheets, strips, plates, sections, girders, by means of a straightening machine with straightening rolls and a frame, the method including measuring straightening forces of at least one of the straightening rolls in the roll straightening machine and adjusting the positions of the straightening rolls in accordance with the measured values of the straightening forces, the improvement comprising individually measuring by means of measuring devices each straightening force acting perpendicularly and directly on the axes of rotation of the straightening rolls and of the roll bearings and measuring by means of measuring devices displacement distances of the straightening rolls resulting from the straightening forces due to elastic deformation of the frame of the straightening machine, and automatically correcting the positions of the straightening rolls which are adjustable during the straightening procedure, within a range of the occurring varying straightening forces, in dependence on the force measured by the measuring devices and in dependence on the displacement distances measured by the measuring devices, the automatic correction being effected such that a parallel displacement of the straightening roll axes resulting from the correction extends in a direction which is opposite the direction determined by the displacement of the axes caused by the elastic deformations of the machine wherein the parallel displacement is a displacement rom a first position to a second position with the two positions being parallel to one another.

2. The method according to claim 1, wherein the correction value of a straightening roll position corresponds to the radial displacement of a straightening roll due to elastic deformation of the material being straightened.

3. The method according to claim 1, wherein correction value of a straightening roll position is greater than the vertical displacement of a straightening roll due to elastic deformation of the material being straightened.

4. The method according to claim 1, wherein the correction value of a straightening roll position is smaller than the vertical displacement of a straightening roll due to elastic deformation of the material being straightened.

5. The method according to claims 2, 3 or 4 wherein correction values of the straightening roll positions are computed in accordance with the following formula and the corrections are effected in accordance with the correction values:

$$\begin{pmatrix} \Delta p_1 \\ \cdot \\ \cdot \\ \cdot \\ \cdot \\ \Delta p_k \end{pmatrix} = C \begin{pmatrix} \cdot & & \\ \cdot & & \\ \cdot & & \\ \cdots & m_{ij} & \cdots \\ \cdot & & \\ \cdot & & \\ \cdot & & \end{pmatrix} \begin{pmatrix} F_1 \\ \cdot \\ F_l \\ u_1 \\ \cdot \\ \cdot \\ u_m \end{pmatrix};$$

for $i=1, \ldots, k$ and $j=1, \ldots, l+m$, wherein $\Delta p_1, \ldots, \Delta p_k$: changes of the total number k of straightening roll positions adjustable under load.

$F_1, \ldots, F_l$: measurement values of the total number l of force measuring locations, $u_1, \ldots, u_m$: measurement values of the total number m of measured elastic deformations, $m_{ij}$: partial derivatives of the straightening roll positions $a_1, \ldots, a_k$ belonging to $\Delta p_1, \ldots, \Delta p_k$ by the measurable forces or elastic deformations:

$$m_{ij} = -\frac{\theta \Delta a_i}{\theta F_j} \text{ for } j <= l;$$

-continued $$m_{ij} = -\frac{\theta\ \Delta a_i}{\theta\ u_{j-1}} \text{ for } j > 1, \text{ and}$$

c: multiplication factor which is adaptively adjustable manually and/or automatically in dependence on the product and/or depending on the straightening result.

6. The method according to claim 5, wherein C is between $-2.5$ and $+2.5$.

7. The method according to claim 6, wherein $C=1$.

8. The method according to claim 6, wherein $C>1$.

9. The method according to claim 6, wherein $C<1$.

10. In a method for straightening sheets, strips, plates, sections, girders, by means of a straightening machine with straightening rolls and a frame, the method including measuring straightening forces of at least one of the straightening rolls in the roll straightening machine and adjusting the positions of the straightening rolls in accordance with the measured values of the straightening forces, the improvement comprising individually measuring by means of measuring devices each straightening force acting perpendicularly and directly on the axes of rotation of the straightening rolls and of the roll bearings and measuring by means of measuring devices deplacement distances of the straightening rolls resulting from the straightening forces due to elastic deformation of the frame of the straightening machine, and automatically correcting the positions of the straightening rolls which are adjustable during the straightening procedure, within a range of the occurring varying straightening forces, in dependence on the forces measured by the measuring devices and in dependence on the displacement distances measured by the measuring devices, the automatic correction being effected such that a parallel displacement of the straightening roll axes resulting from the correction extends in a direction which is opposite the direction determined by the displacement of the axes caused by the elastic deformations of the machine where, in addition to correcting the positions of the straightening rolls, another correction is carried out in dependence on at least one of the following properties measured on the material being straightened: yield point, width, thickness wherein the parallel displacement is a displacement from a first position to a second position with the two positions being parallel to one another.

* * * * *